United States Patent [19]

Brodie et al.

[11] Patent Number: 4,923,421

[45] Date of Patent: May 8, 1990

[54] METHOD FOR PROVIDING POLYIMIDE SPACERS IN A FIELD EMISSION PANEL DISPLAY

[75] Inventors: Ivor Brodie, Palo Alto; Henry R. Gurnick, Pleasanton; Christopher E. Holland, Redwood City; Helmut A. Moessner, Saratoga, all of Calif.

[73] Assignee: Innovative Display Development Partners, Menlo Park, Calif.

[21] Appl. No.: 215,603

[22] Filed: Jul. 6, 1988

[51] Int. Cl.[5] ..... H01J 17/49

[52] U.S. Cl. ..... 445/24; 445/40

[58] Field of Search ..... 445/24, 25, 40; 313/309; 358/56, 230

[56] References Cited

U.S. PATENT DOCUMENTS

| | | | |
|---|---|---|---|
| 3,789,470 | 2/1974 | Owaki et al. | 445/25 |
| 3,912,366 | 10/1975 | Sprokel | 350/339 R |
| 4,020,381 | 4/1977 | Oess et al. | 313/309 X |
| 4,422,731 | 12/1983 | Droguet et al. | 445/24 |
| 4,451,759 | 5/1984 | Heynisch | 445/22 |
| 4,639,089 | 1/1987 | Okada et al. | 350/341 |
| 4,721,885 | 1/1988 | Brodie | 313/309 |
| 4,763,187 | 8/1988 | Biberian | 313/309 |

*Primary Examiner*—Kenneth J. Ramsey

*Attorney, Agent, or Firm*—Flehr, Hohbach, Test, Albritton & Herbert

[57] ABSTRACT

A flat panel display of the field emission cathode type is described having polyimide spacers or pillars separating the emitting surface and display face of the same. A method of forming the spacers by integrated circuit techniques also is described.

10 Claims, 3 Drawing Sheets

METHOD FOR PROVIDING POLYIMIDE SPACERS IN A FIELD EMISSION PANEL DISPLAY

The present invention relates to flat panel displays of the field emission cathode type and, more particularly, to the formation of spacers between a cathode array and the display face of such a panel, and the resulting structure.

Flat panel displays are widely used to visually display information in many situations in which the bulk associated with conventional cathode ray tube displays is a major disadvantage. They are used as portable personal computer displays and for some panel and other operational displays in which space is at a premium or weight is a significant consideration. Some flat panel displays are based upon field emission type cathode arrays. Such a display panel is described in U.S. patent application Ser. No. 891,853 entitled MATRIX-ADDRESSED FLAT PANEL DISPLAY having the same assignee as this application. These types of displays have the advantage of relying on the well developed cathodoluminescent-phosphor approach of CRTs while yet providing a particularly thin, simple and high resolution display formed in large part by techniques of the type used to form integrated circuitry.

It is important in flat panel displays of the field emission cathode type that the particle emitting surface and the opposed display face be maintained insulated from one another at a relatively small, but uniform distance from one another throughout the full extent of the display face. There is a relatively high voltage differential, e.g., generally above 200 volts, between the cathode emitting surface and the display face. It is important that electrical breakdown between the emitting surface and the display face be prevented. However, the spacing between the two has to be small to assure the desired thinness and that the high resolution is achieved. This spacing also has to be uniform for uniform resolution, brightness, to avoid display distortion, etc. Nonuniformity in spacing is much more likely to occur in a field emission cathode, matrix addressed flat vacuum type display than in some other display types since there typically also is a high differential pressure on the opposed sides of the display face, e.g., whereas the exposed side of such face is at atmospheric pressure, a high vacuum of less than $10^{-6}$ torr, generally is applied between the cathode structure and the other side of the display face.

In the past, many spacer arrangements for field emission type cathode flat panel displays have been provided by one or more structures which are separate from the cathode array and display face, such as is described in U.S. Pat. No. 4,183,125 for gas discharge displays. This has resulted in registration problems. Slight deviations from optimum registration can have a major impact on the quality of the display. That is, if in a high resolution arrangement the spacer is not properly registered electrons emitted from a cathode array will be intercepted before striking a phosphor coated display face, with the result that brightness will be materially affected. This is particularly a problem in a high resolution arrangement in which adjacent pixels are closely packed relative to one another.

The previously mentioned patent application Ser. No. 891,853 describes a spacer approach in which parallel legs are provided integrally connected with the display face plate, interspersed between adjacent rows of pixels. While this approach has merit, it also has manufacturing and assembling problems.

Uniformity of spacing is particularly a problem. One approach in the past has been to use a metal to connect spacers, which metal is then coated with a dielectric layer. This approach is used in U.S. Pat. No. 4,091,305 for a gaseous discharge type of flat panel display. It is not conducive to being used in a field emission type arrangement, because of the high voltage differential necessary between the anode and cathodes of such an arrangement. This high voltage can exceed the breakdown potential of the dielectric and result in the metal of the spacer posts causing a voltage short between the faceplate and the cathode emitting surface.

Another approach that has been used is to provide interacting spacer parts on the display face and the cathode construction. U.S. Pat. No. 4,422,731 illustrates such an arrangement in a liquid crystal display flat panel. Such an approach when applied to a field emission cathode array based flat panel has the registration problems discussed above. Instead of such registration problems being between a spacer construction and a cathode, they are between the cathode emitting surface and display face themselves. That is, even a slight misalignment between the cathode and the display face can result in the spacer parts being misaligned and consequent voltage breakdown, display nonuniformity, etc. U.S. Pat. No. 4,451,759 issued to Heynisch shows such an arrangement for a flat panel display in which metal pins on the face register with hollow cylinders projecting from the cathode. This effort to obtain the structural advantages associated with use of metal for the spacer pins while yet preventing electrical breakdown, has the disadvantage of the registration problems discussed above.

SUMMARY OF THE INVENTION

The present invention utilizes a technique commonly used in the integrated circuit industry to form spacers of a uniform height in a flat panel display of the field emission type, and the structure resulting therefrom. In broad terms, the process of the invention comprises applying a layer of material from which the spacers are to be formed either to the surface of the field emission cathode or to the opposing display face, patterning the spacers from the layer of material, removing the layer except for the portions forming the desired spacers, and thereafter sandwiching together the display face and cathode surface with the desired spacers between the same.

Most desirably, the spacers are formed from a polyimide material, a polymerized organic polymer capable of withstanding the high bakeout temperature associated with formation of the high operating vacuum necessary in a field emission cathode type of display. It is formed by pouring a solution containing a polyamic ester, a precursor to polyimide, onto the cathode emitting surface, and spinning such surface. The result is that a uniformly thick layer of the polyamic acid and, hence, the polyimide spacers when the acid is imidized, will be applied to the surface. Such material can be made photosensitive and standard photolithography techniques used in the integrated circuitry industry are used to form the actual spacers prior to imidization.

It has been found that a polyimide can be used for the spacers even though it is organic and the traditional view is that the outgassing of an organic material will deleteriously affect the vacuum which must be applied between the emitting surface and the display face. Baking out of the preferred polyimide at a high temperature (over 400° C.) in an ultra-high vacuum ($10^{-9}$ torr) will remove all the volatile components. Moreover, the manner in which the spacers are formed provides a multitude of quite small, uniformly sized spacers to be provided. This enables quite thin plates to withstand a full atmosphere pressure differential. The use of integrated circuitry techniques to form the spacers is particularly advantageous in a field emission cathode based display since such a cathode is otherwise formed by such techniques.

BRIEF DESCRIPTION OF THE DRAWINGS

With reference to the accompanying three sheets of drawing.

DETAILED DESCRIPTION OF A PREFERRED EMBODIMENT

Figure 1:
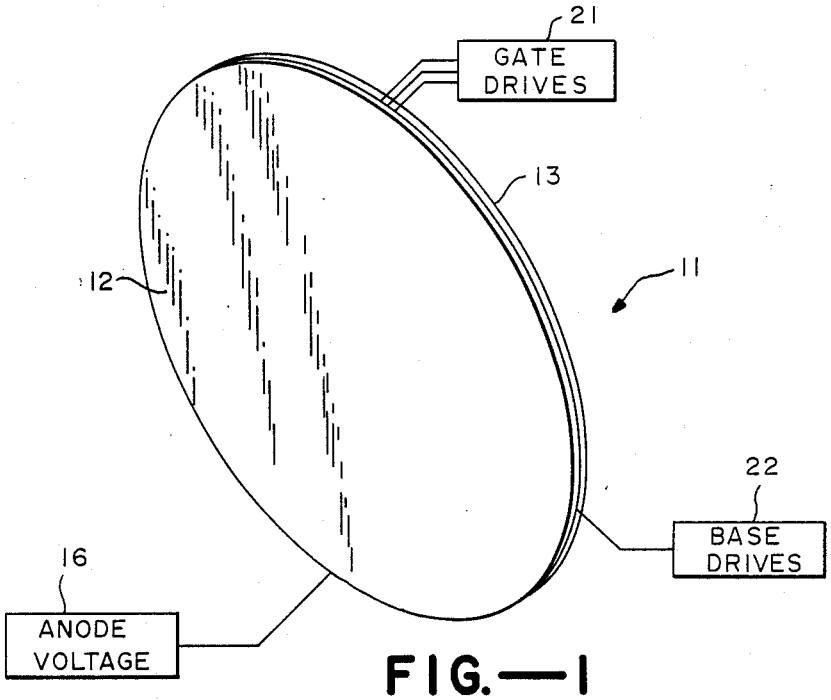
FIG. 1 is an overall isometric and schematic view of a preferred embodiment of display panel of the invention having a field emission cathode base.

FIG. 1 schematically illustrates a preferred embodiment 11 of a flat panel display of the invention. It includes a transparent face plate or structure 12 and a backing plate 13. While the panel is illustrated as being disc shaped, it will be appreciated that it can be of other shapes. In this connection, the backing plate most desirably is a semiconductor wafer providing a square array of field emission cathodes of the type described in, for example, U.S. Pat. Nos. 3,665,241; 3,755,704; and 3,791,471, the disclosures of which are hereby incorporated by reference.

Figure 4:
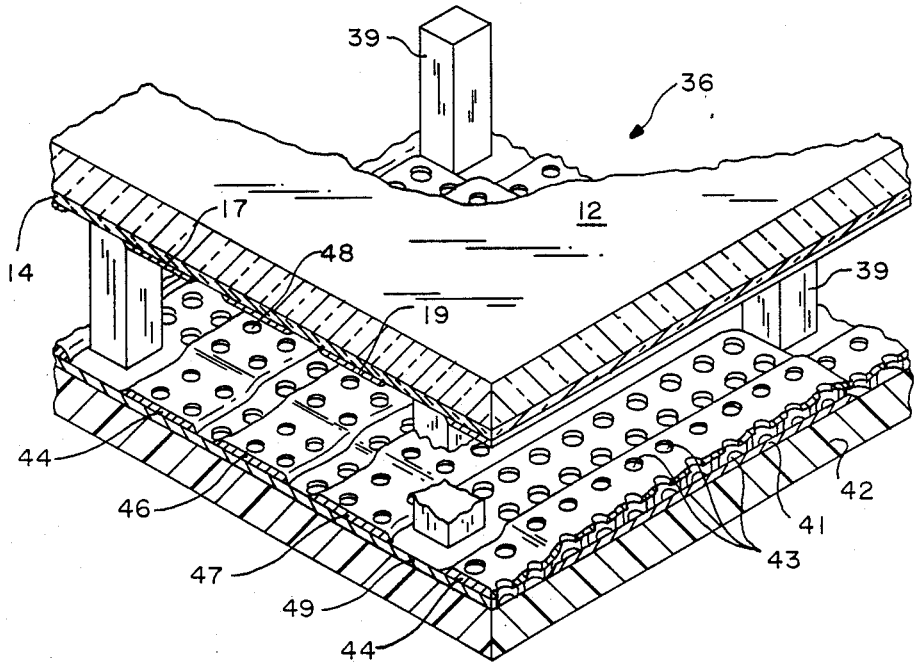
FIG. 4 is an enlarged, partial view illustrating a single pixel of the preferred embodiment.

Face plate 2 is transparent and provides the display. It includes an anode represented at 14 (FIG. 4) on its face opposed to the particle emitting surface of the cathodic array to assure appropriate bombardment by electrons emitted from such array. A voltage, which is positive relative to the cathode by about 400 or more volts is applied thereto from an appropriate source as schematically represented at 16 in FIG. 1. The display being described is chromatic and, in this connection, each pixel of the same includes three phosphor strips 17, 18 and 19 for each of the three primary colors—red, green and blue. As best illustrated in FIG. 4, such strips are applied over the anode 14 of the display face. They can be formed by standard photodeposition techniques.

Figure 2:
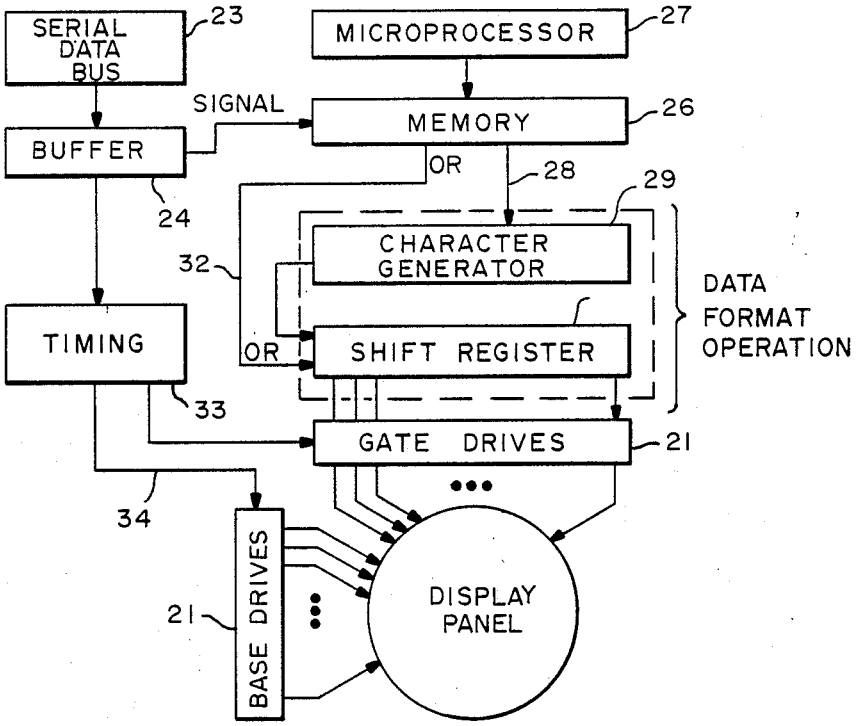
FIG. 2 is a schematic block diagram view of an addressing scheme incorporated into the preferred embodiment.

The preferred embodiment of the flat panel display of the invention being described is matrix addressable. To this end, the cathode of each pixel includes orthogonally related address lines which are driven individually as is schematically represented in FIGS. 1 and 2 by cathode base drive block 21 and cathode gate drive block 22. Three flow lines extend from the gate drive block 22 to the display, whereas only one is shown extending from the base drive block 21, in order to illustrate their relationship, i.e., there are three gates to be individually energized for each base.

A standard matrix-addressing scheme usable with the invention is illustrated in FIG. 2. A serial data bus represented at 23 feeds digital data defining a desired display through a buffer 24 to a memory represented at 26. A microprocessor 27 controls the output of memory 26. If the information defines an alphanumeric character, the output is directed as represented by line 28 to a character generator 29 which feeds the requisite information defining the desired character to a shift register 31 which controls operation of the gate drive circuitry. If on the other hand the information defines a display which is not an alphanumeric character, such information is fed directly from the memory 26 to shift register 31 as is represented by flow line 32.

Timing circuitry represented at 33 controls operation of the gate drive circuitry, which operation is synchronized with the base drives as represented by flow line 34. Timing of the energization of gates orthogonal to a selected base will be controlled, so that the bases and gates of a selected row of pixels will be simultaneously energized to produce electrons to provide the desired pixel display. An entire row of pixels is simultaneously energized, rather than individual pixels being energized alone in a raster scan manner as is more conventional. Row energization assures that each pixel has a long duty cycle for enhanced brightness. It will be recognized by those skilled in the art that full column and individual row energization will provide basically the same results. Line scanning then will be vertical column lines, rather than horizontal row lines.

Figure 3:
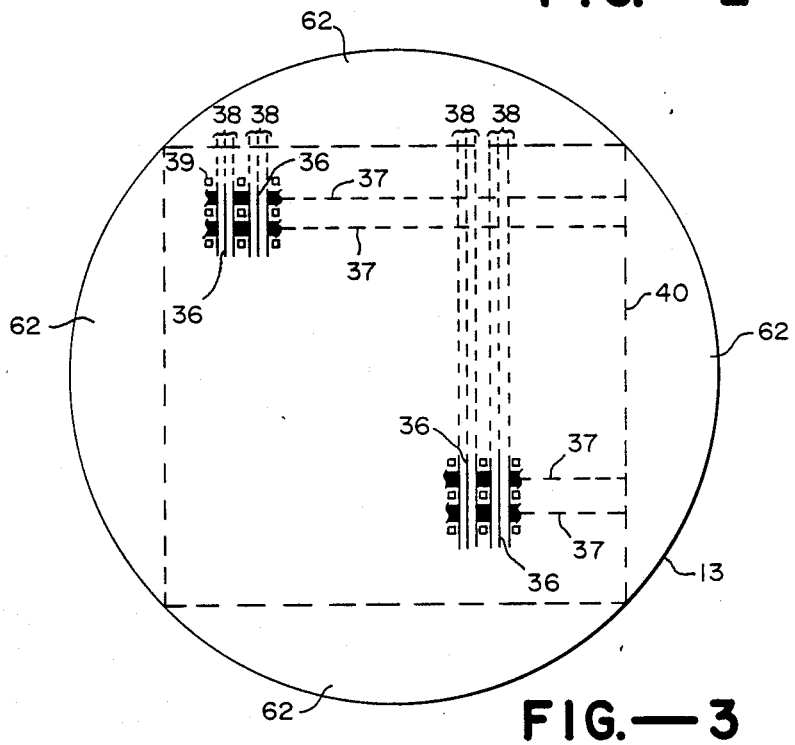
FIG. 3 is a planar, sectional view illustrating a field emission cathode having a multitude of spacers as incorporated into, and by, the instant invention.

FIG. 3 is a planer view of a field emission cathode array for a display of the invention, showing the emitting surface thereof divided into a matrix of pixels. Each of the pixels, generally referred to by the reference numeral 36, includes one base electrode 37 formed by photodeposition techniques and three gates 38 which are orthogonally related thereto. For simplicity sake, FIG. 3 schematically illustrates only two, greatly enlarged sections of such pixels. The pixel matrix, however, extends over the full surface area encompassed within square 40 on backing plate substrate 13.

In keeping with the invention, a plurality of spacers or "pillars" 39 circumscribe each of the pixels. As will be discussed in more detail hereinafter, each of the spacers 39 is formed by an integrated circuit technique resulting in it having a relatively small "foot" on the particle emitting surface, i.e., its transverse dimensions at the emitting surface are approximately 50 microns by 50 microns. Thus, a multitude of such spacers can be, and is, provided with each pixel to minimize even local area display distortions which might be caused by differential pressure.

A single pixel is enlarged in FIG. 4 to facilitate an understanding of the structure. Each pixel is surrounded by four spacers or pillar 39. The base electrode 37 is a layer strip 41 of a conductive material applied to an insulating substrate 42. As illustrated, base strip 41 is relatively wide and extends between the four spacers. That is, it extends between the horizontal paths defined on the substrate 42 by the spacers 39 of horizontally adjacent pixels. As best illustrated at one of the broken edges in FIG. 4, such strip has electron emitting tips 43.

The cathode emitting surface further includes for each of the pixels, three gate electrodes 44, 46 and 47 which are orthogonal to the base 41. Such gate electrodes include apertures 48 which are aligned with the electron emitting tips 43 of the base and act to control extraction of electrons therefrom. In this connection, the electrode strips are electrically insulated from the base substrate by an insulating layer of, for example, silicon dioxide.

Gate electrodes 44 through 47 respectively are aligned with phosphors 17 through 19. When the individual pixels are turned "on", the electrodes at the "on" pixel act to control the density of electrons which are emitted to bombard the respective phosphors and create luminance at such pixel. The electrical field created by the potential difference between the anode 14 and the cathode array will assure that the particles have the requisite energy to cause fluorescence.

There are certain criteria that must be met by the pillars 39. For one, they must be sufficiently non-conductive to prevent electrical breakdown between the cathode array and the anode, in spite of the relatively close interelectrode spacing, e.g., 100 microns, and yet relatively high potential differential, e.g., 200 or more volts. Moreover, they also must provide very little creep (slow deformation over time) to assure that the flat panel display will have an appreciable useful life. They must be stable under electron bombardment. That is, electrons will be generated at each of the pixels and could bombard the spacers. Such spacers must be able to withstand the electron bombardment without deleterious effects. The spacers also should be able to withstand the relatively high bakeout temperatures, e.g., 400° C., to which the flat panel display will be subjected in the process of creating the high vacuum between the face and backing plates necessary in a field emission cathode type display.

While various materials may satisfy the above criteria, it has been found that polyimide resins are particularly useful. They already are used in the formation of interlevel dielectrics in integrated circuitry and have been studied extensively. (See, for example, the article entitled "Polyimides in Microelectronics", written by Pieter Burggraff, appearing in the March 1988 issue of *Semiconductor International,* page 58.) As brought out in such paper, certain polyimide formulations are photosensitive and can be patterned by standard integrated circuitry type photolithography. Polyimides are prepared from polycondensation reaction of an aromatic dianhydride and an aromatic diamine. They generally are obtained in a preimidized form as a polyamic acid or ester. Such acid or ester is readily soluble in polar organic solvents and converts to polyimide at high temperatures which remove such solvents.

A polyimide which has been found to be particularly useful in the preferred embodiment is the polyimide solid by the Electronic Chemicals Group of CIBA-GEIGY Corporation of Santa Clara, California, as its Probimide 348 FC formulation. The precursor formulation is photosensitive and has a viscosity of about 3500 c.s. It is an NMP solution containing about 48% by weight of a polyamic ester, a surfactant for wetting, and a photosensitizer.

Figure 5:
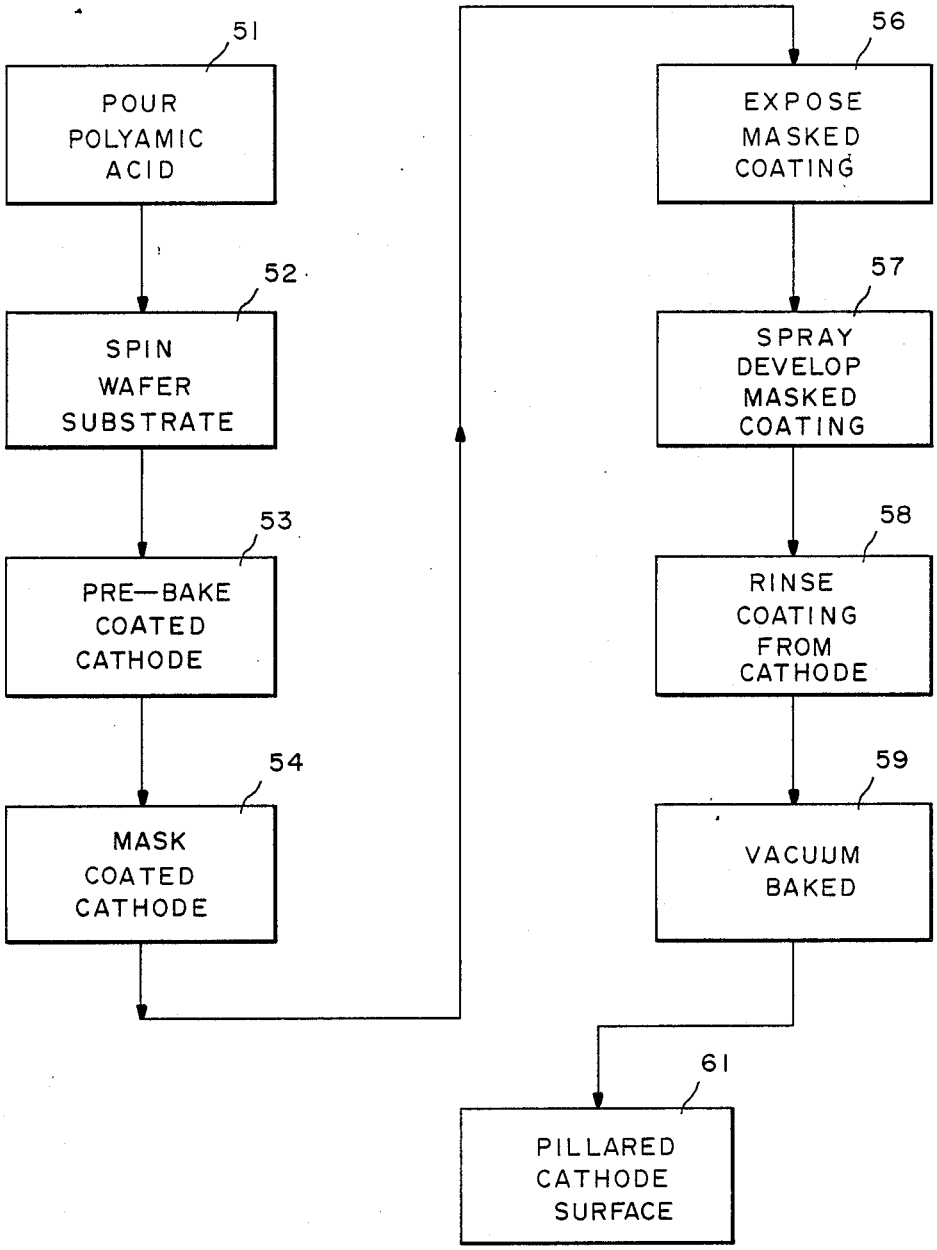
FIG. 5 is a flow diagram illustrating a preferred embodiment of the process of the invention.

FIG. 5 illustrates a preferred embodiment of the process of the invention, in diagrammatic form. Most desirably, the precursor to the polyimide is applied to the substrate by a spinning operation. This assures that the precursor is uniformly applied, with the result of the spacers when formed will be of a uniform height. With reference to FIG. 5 the formulation for Probimide 348 FC is poured onto the cathode emitting surface after the wafer is set up on a chuck or the like for spinning. This formulation is viscous as brought out above and it is poured on about one-third of the substrate semiconductor wafer from its center out. The pouring operation is represented in FIG. 5 by block 51. The substrate is then spun at a speed and for a sufficiently long time to provide the desired coating thickness. In the specific embodiment being described, the substrate is spun at 650 RPM for approximately 9 seconds. The viscous precursor formulation will form a uniform coating layer on the wafer having a thickness of about 125 microns. Block 52 illustrates such spinning.

It should be noted that although the spacers could be formed on the display face rather than the particle emitting cathode surface, it is preferred that it be formed on the cathode itself to avoid the possibility of contaminating the phosphor materials on the faceplate, leading to reduced efficiency.

The cathode is prebaked for approximately 30–40 minutes at about 100° C. after the precursor is applied. The purpose of this prebaking is to remove organic solvents from the precursor. Such prebaking is represented in FIG. 5 by block 53.

The desired spacer matrix is then patterned onto the coated cathode with an appropriate mask. It is important that the mask be properly aligned to assure that the final spacers will be located correctly. It should be noted that the technology for accurate masking is quite well developed relative to the formation of integrated circuits, and it is easy with available equipment to obtain the accurate alignment which is necessary when integrated circuit techniques are being used to form the spacers as with the instant invention. Block 54 in FIG. 5 represents this patterning step.

After the mask is appropriately aligned with the wafer substrate, the wafer is exposed for development by being subjected to radiation in the ultraviolet frequency range for about 20 minutes. This operation is illustrated in FIG. 5 by block 56. Moisture is then driven out of the substrate by placing the same in an oven at a temperature of approximately 90–100° C. for about 20 minutes. While such substrate is still warm, the mask coating is sprayed with an atomizing spray nozzle, with an appropriate developer material, such as the QZ 3301 developer available from the previously mentioned Electronic Chemicals Group of CIBA-GEIGY Corporation, until one can visually see the development. Block 57 represents such spraying. The portion of the coating which is unexposed is then removed from the cathode by rinsing it with an appropriate rinse solution, such as QZ 3312 rinse solution also available from the previously mentioned Electronic Chemicals Group of CIBA-GEIGY. This removal of the layer of precursor except for those portions which form the desired spacer matrix, is represented in FIG. 5 by block 58.

The substrate is patterned with the desired spacers by such procedure, formed from the polyimide precursor. Their height will be about 125 microns. The spacer matrix is then subjected to a high temperature and high vacuum for a final curing to form the desired polyimide spacers. That is, the cathode with the spacer matrix is subjected to a temperature of about 400° C. for about one hour in an ultra-high ($10^{-9}$ torr) vacuum. The temperature of the cathode is linearly ramped to this temperature by changes in temperature at a rate of 2° C. per minute. Block 59 in FIG. 5 represents such curing step.

The result of the above operation is the formation of the desired spacers or, in other words, a pillared cathode surface, as indicated by block 61 in FIG. 5. It has been found that the pillars shrink to a 100 micron approximate size during the curing stage. This shrinking does not affect the uniformity of the height of the spacers which is desired. However, it does result in the spacers being more dense and having greater structural integrity.

After the spacers are formed on the cathode emitting surface, the cathode and display faceplate are properly aligned and sandwiched together. It will be appreciated that such operation is simplified in the preferred embodiment by the fact that the spacers are formed entirely on one surface, i.e., it is not necessary to properly align spacer parts on the two surfaces. The panel faces then can be appropriately sealed, and a desired vacuum to prevent Paschen breakdown in the interelectrode space, i.e., the space between the cathode and anode, can be formed. As previously mentioned, the polyimide spacers that are formed can withstand high temperature, e.g., 400° C. bakeout during the vacuum formation.

It will be seen that substantially the full spacer array of the invention can be limited to that area of the cathode surface having the pixel array. That is, the number of spacers at those areas of the substrate that are not part of the electron emitting portion thereof can be minimized. This means that the substrate segments 62 (FIG. 3) are available for formation via integrated circuitry techniques of the electronics which will be associated with the display, such as input and output processing electronics, matrix connections, etc. Also, the back side of the substrate, i.e., the side of the same opposed to the emitting surface, is available for use in forming desired circuitry for the display. "Through-the-wafer" connections of the type described in the previously mentioned U.S. patent application Ser. No. 891,853 also can be utilized in combination with the instant invention.

The invention has been described in detail in connection with a preferred embodiment thereof. It will be appreciated, however, that many variations will occur to those skilled in the art. For example, although the polyimide formulation previously mentioned can be used, other materials may well form a desired spacer pattern for field emission cathode type panels of other constructions. It is therefore intended that the coverage afforded applicant be limited only by the claims and their equivalents.

What I claim is:

1. A process for forming and using spacers between the emitting surface of a field emission cathode array and an opposing display face, comprising the steps of A. applying a layer of material from which said spacers are to be formed either to said cathode surface or said face;

B. patterning said layer of material with the desired spacer matrix;

C. removing said layer from said face or surface except for portions thereof to form said spacer matrix;

D. baking said spacer matrix to a high temperature in an ultra-high vacuum to remove volatile material from spacers of said matrix;

E. sandwiching together said display face and said cathode surface with spacers of said matrix therebetween;

F. forming a vacuum between said surface and said face; and

G. retaining a vacuum between said surface and said face during emission from said field emission cathode surface toward said display face.

2. The process of claim 1 further including the step of shrinking said spacers.

3. The process of claim 1 wherein said layer of material is applied by pouring a viscous fluid of material from which said spacers are to be formed onto a substrate providing said surface or face, and spinning such substrate to cover the same with a uniformly thick layer of said material.

4. The process of claim 3 wherein said layer of material is applied to said cathode surface.

5. The process of claim 1 wherein said material is a photoresistive material, and said step of patterning includes the steps of masking said layer of material at all locations at which spacers are not desired and developing the exposed material.

6. The process of any of claims 3 through 5 wherein said material is a polyimide precursor.

7. The process of claim 6 further including the step of imidizing the same to form polyimide spacers.

8. The process of claim 1 wherein said cathode surface forms a matrix of electron generation sites and a multitude of said spacers are provided located between said sites.

9. The process of claim 8 wherein said opposed display face is provided by a display panel that is transparent to light at said face, and a plurality of phosphors are associated with said face in registration with selected ones of said electron emitting sites whereby a matrix addressable, flat panel display is provided.

10. The process of claim 9 wherein said plurality of phosphors are provided by generally parallel phosphor strips, and further including the step of forming a matrix array of pixels, each one of which includes at least a portion of each of said strips, and wherein said step of patterning said spacer matrix includes patterning a plurality of spacers adjacent each location desired for a pixel.

* * * * *